United States Patent [19]

Wilson

[11] 4,215,498

[45] Aug. 5, 1980

[54] SAFETY TAGGING DEVICE

[76] Inventor: James G. Wilson, 28 Donna Dr., Albany, N.Y. 12205

[21] Appl. No.: 954,905

[22] Filed: Oct. 26, 1978

[51] Int. Cl.[3] ..... G09F 3/14

[52] U.S. Cl. ..... 40/21 R

[58] Field of Search ..... 40/10, 21, 21 C, 316, 40/584

[56] References Cited

U.S. PATENT DOCUMENTS

| | | | |
|---|---|---|---|
| 753,457 | 3/1904 | Weissbrod | 40/21 C |
| 2,201,139 | 5/1940 | Ivey | 40/21 R |
| 2,599,111 | 6/1952 | Kicher | 40/19 |
| 2,821,035 | 1/1958 | Joseph | 40/586 |
| 3,088,237 | 5/1963 | Plummer | 40/316 |
| 3,295,237 | 1/1967 | Rooney | 40/586 |
| 4,154,011 | 5/1979 | Rakestraw | 40/21 C |

FOREIGN PATENT DOCUMENTS

| | | | |
|---|---|---|---|
| 1515632 | 1/1968 | France | 40/21 C |

*Primary Examiner*—Louis G. Mancene
*Assistant Examiner*—Wenceslao J. Contreras
*Attorney, Agent, or Firm*—James J. Romano, Jr.

[57] ABSTRACT

New and improved safety tagging device is provided which is fabricated from highly visible, durable and weather-resistant materials and which is readily and conveniently, securely attachable to and removable from power transmission and distribution circuit support structures and the like. The device is operable to protectively and conspicuously display, and call attention to, a mark-up card with instructions regarding safety prerequisites attendant the re-energization of de-energized power transmission or distribution circuit.

9 Claims, 5 Drawing Figures

SAFETY TAGGING DEVICE

BACKGROUND OF THE INVENTION

1. Field of the Invention

This invention relates to a new and improved safety tagging device for use in tagging a wide variety of de-energized power transmission and distribution circuits and/or circuit components.

2. Description of the Prior Art

Although mark-up tags, per se, have long been known and used to indicate de-energized power transmission and distribution circuits and/or components, and to identify and locate the person responsible for circuit de-energization, it may be understood that no truly satisfactory device currently exists for attaching these mark-up tags to the power transmission and distribution circuit support and/or related structure in such manner that the mark-up tag is readily and highly visible and remains intact, legible and reliably attached despite environmental conditions tending to obliterate, obscure and/or dislodge the same. More specifically, and taking for example a situation wherein disconnect devices such as power fuse switches on distribution and transmission pole have been actuated by a first line crew to de-energize a fallen power transmission or distribution line during a severe wind and ice storm which occurs at night, it will be understood by those skilled in this art that prior art practice dictates the stapling (assuming, of course, the pole to be wood) or wiring of the relatively small (for example, only three by four inches), heavy paper mark-up tag, per se, to the riser pole with the results that the darkness and/or adverse weather conditions can function to render the thusly attached and unprotected mark-up tag far less than readily visible, and to obliterate, obscure and/or dislodge the same, thus giving rise to the potentially fatal possiblity of a subsequent line crew not seeing the mark-up tag and re-energizing the fallen power transmission or distribution line in question. Alternatively, dislodgement of the thusly attached mark-up tag can occur through the same being struck by a falling tree or tree branch, or by the mark-up tag being scraped from the riser pole as a result of the support platform or bucket of a personnel lifting device rubbing against the riser pole.

OBJECTS OF THE INVENTION

It is, accordingly, an object of my invention to provide a new and improved safety tagging device which functions to attach mark-up tags to power transmission and distribution circuit support and/or related structure in highly visible and conspicuous manner.

Another object of my invention is the provision of a safety tagging device as above which functions to attach mark-up tags in extremely reliable and fully protected, albeit readily removeable, manner.

Another object of my invention is the provision of a safety tagging device as above which is particularly easy to utilize thereby requiring no specialized training in the utilization thereof.

A further object of my invention is the provision of a safety tagging device as above which is of simple construction, and which requires the use of only relatively inexpensive, readily available materials of proven dependability in the fabrication thereof to thus result in a particularly economical and reliable device.

SUMMARY OF THE INVENTION

The new and improved safety tagging device of my invention comprises a generally quadrangular main body portion having elasticized mounting bands extending from opposite sides thereof. Streamers are secured to the main body portion to hang therefrom. The main body portion, mounting bands and streamers are preferably made from particularly strong, durable and weather resistant materials in the nature of synthetic fabrics, and are preferably colored in an extremely high visibility color such as blaze fluorescent orange. A mark-up tag holder is secured to the front of the main body portion and includes a receptacle for the protected containment of a mark-up tag. In use, for example, the safety tagging device is firmly secured around a de-energized transmission or distribution pole by cooperative attachment means on the mounting bands, and functions to provide highly visible, weather resistant, and particularly secure indicia of the fact that the transmission or distribution line is not to be re-energized without appropriate clearances in accordance with the instructions on the mark-up tag. Alternatively, the safety tagging device of my invention can also be utilized as described on steel support structures that support disconnects in substations.

DESCRIPTION OF THE DRAWINGS

The above and other objects and significant advantages of my invention are believed made clear by the following detailed description thereof taken in conjunction with the accompanying drawings wherein.

DETAILED DESCRIPTION OF THE INVENTION

Figure 1:
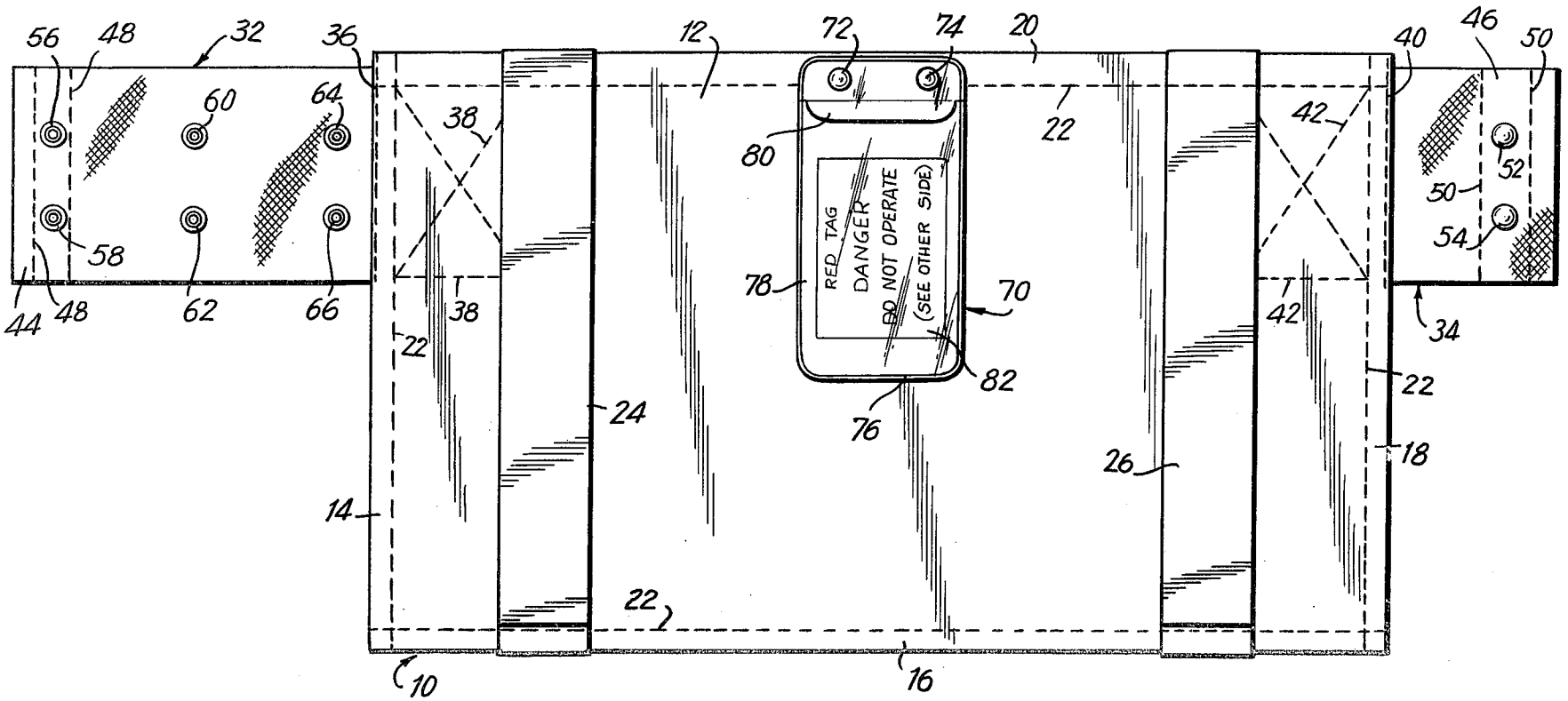
FIG. 1 is a front view of a new and improved safety tagging device constructed and operative in accordance with the teachings of my invention.
Figure 2:
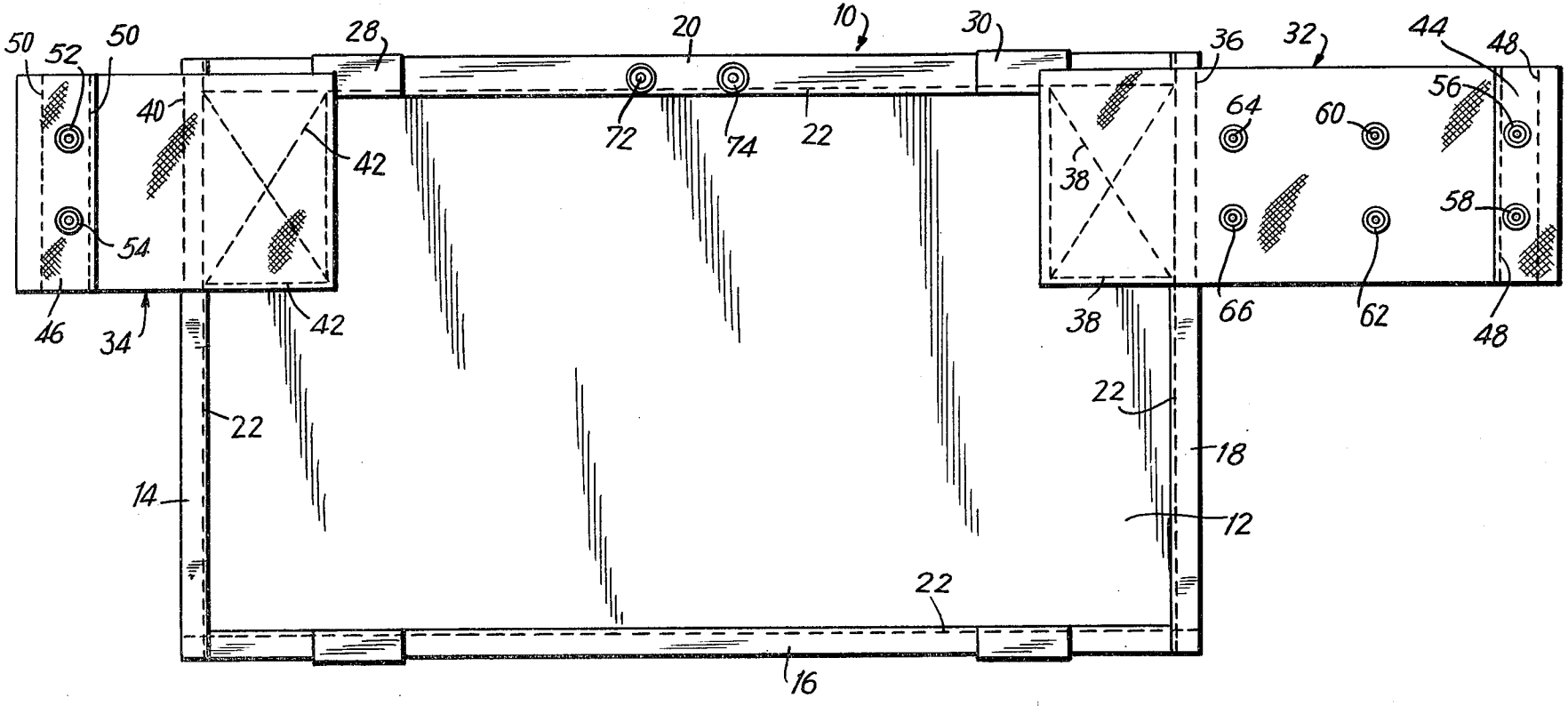
FIG. 2 is a rear view of the safety tagging device of FIG. 1.

Referring now to FIGS. 1 and 2 of the drawings, a preferred embodiment of a new and improved safety tagging device constructed and operative in accordance with the teachings of my invention is indicated generally at 10 and comprises a main body portion as indicated at 12. The main body portion 12 is preferably of the depicted, generally quadrangular configuration and is preferably made from a particularly durable and weather resistant material in the nature, for example, of Dacron, Nylon or similar synthetic fabric of proven high strength characteristics. In addition, the main body portion 12 is further strengthened by the provision of seams 14, 16, 18 and 20 at the respective borders thereof by appropriate stitching as indicated at 22.

Streamers are indicated at 24 and 26, and are formed as shown by generally elongate strips of the same synthetic fabric material from which the main body portion 12 is made. The streamers 24 and 26 are firmly and securely attached to the main body portion 12 as shown at spaced locations adjacent the upper edge of the latter by folding the respective end-portions 28 and 30 (FIG. 2) of the streamers over the main body portion seam 20 prior to the stitching of the latter, and thereupon running the stitching 22 through both thicknesses of the main body portion and steamer, respectively, to thus result in the particularly firm and secure attachment of the streamers 24 and 26 to the main body portion 12.

Mounting bands of unequal length are indicated generally at 32 and 34 and are respectively securely attached as shown to the main body portion 12 at the opposite, upper rear sides of the latter. More specifically, and referring first to mounting band 32, it will be understood that the same is first positioned as best seen in FIG. 2 to overlay main body portion seams 18 and 20, whereupon the stitching 22 is then emplaced to complete those seams while simultaneously securely affixing the mounting band 32 to both thicknesses of the main body portion 12 at the areas of seams 18 and 20. Additional stitching as indicated at 36 and 38 is then run through the mounting band 32 and relevant areas of the main body portion 12, and seams 18 and 20, to complete the particularly secure attachment of the mounting band 32 to the main body portion 12. Mounting band 34 is securely attached, again as best seen in FIG. 2, in like manner to the main body portion 12 at the opposite upper side of the latter, with the additional stitching being there indicated at 40 and 42.

Strengthening seams as indicated at 44 and 46 are formed as shown at the respective end portions of the mounting bands 32 and 34 by spaced, double lines of stitching as indicated at 48 for mounting band 32, and at 50 for mounting band 34.

The mounting bands 32 and 34 are preferably made from a suitably elasticized, particularly durable and weather resistant material, again in the nature, for example, of Dacron, Nylon or similar synthetic fabric of proven high strength characteristics.

Female snap attachment members are indicated at 52 and 54, and are affixed in conventional manner to mounting band 34 at seam 46 in the depicted, spaced generally aligned row. The female snap attachment members 52 and 54 face rearwardly of the main body portion 12.

Male snap attachment members are indicated at 56, 58, 60, 62, 64 and 66 respectively, and are affixed in conventional manner to mounting band 32 in the depicted, spaced generally aligned rows. The male snap attachment members 56, 58, 60, 62, 64 and 66 face forwardly of the main body portion 12.

A mark-up tag holder is indicated generally at 70 and is securely attached as shown to the upper edge of the front side of main body portion 12 generally centrally thereof by the passage of spaced, attachment members 72 and 74 through both thicknesses of main body portion seam 20. The mark-up tag holder 70 is preferably made from a generally transparent, durable and waterproof material in the nature of colorless vinyl, and includes a strengthening rib 76 formed to extend therearound as shown. An envelope 78 is formed in the tag holder 70 as shown by double thicknesses of the same, and a flap 80 is provided to maintain the interior of envelope 78 weatherproof.

Figure 3:
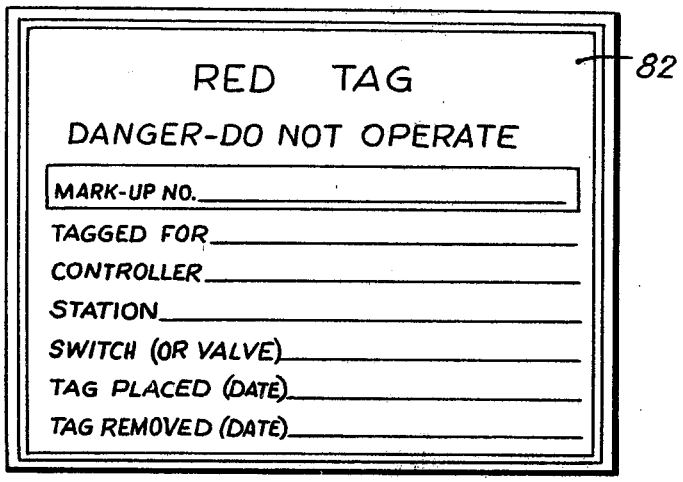
FIG. 3 is a rear view of a mark-up tag as utilized with the safety tagging device of my invention.

A mark-up tag is indicated at 82 and is emplaced as shown in the envelope 78 of tag holder 70 and fully protected thereby from ambient weather conditions as should be obvious. The mark-up tag 82 bears the illustrated or similar notations on the front face thereof; while the rear face of the mark-up tag bears the illustrated or similar notations as shown thereon in FIG. 3.

Preferably, the main body portion 12, the streamers 24 and 26, and the mounting bands 32 and 34, respectively, are each colored in an extremely high visibility color such as blaze fluorescent orange; although the streamers 24 and 26, and/or the mounting bands 32 and 34 alternatively may be colored black, green, or red for contrast with the main body portion 12.

Figure 4:
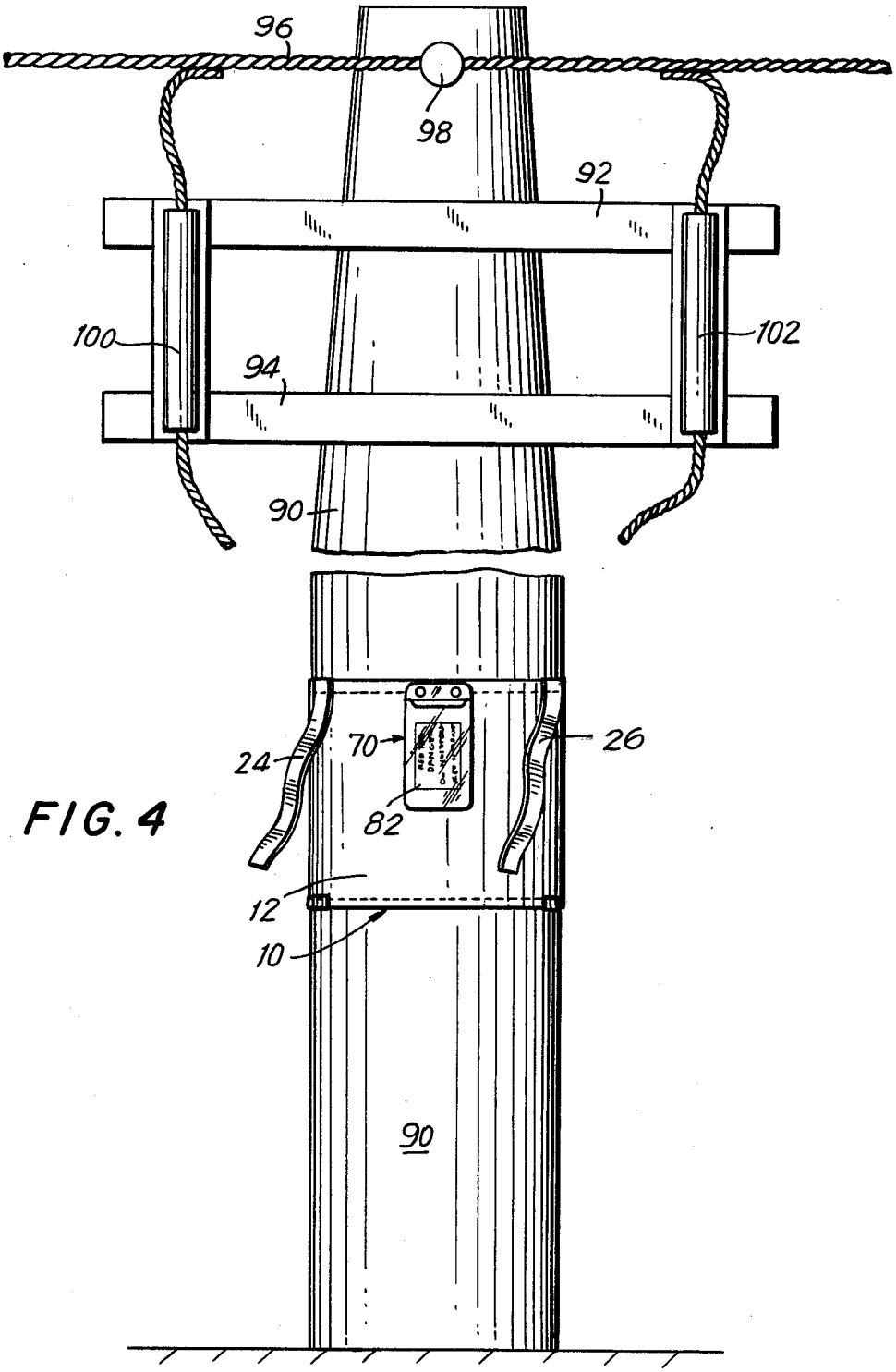
FIG. 4 depicts in somewhat simplified form a typical, power transmission or distribution pole application of the safety tagging device of my invention, with parts omitted and parts cut-away for purposes of simplicity of illustration.

Reference is now made to FIG. 4 wherein a power transmission or distribution pole is indicated at 90, cross-piece supports at 92 and 94, a power transmission or distribution line at 96 and supported from pole 90 by insulator 98, and wherein power fuse disconnect switches are indicated at 100 and 102, respectively, all being shown in somewhat simplified form for purposes of illustration, only, of a typical utilization of the safety tagging device of my invention. For such utilization, and assuming power transmission or distribution line 96 to be down at a location other than that shown as a result, for example, of a severe wind and ice storm occuring at night, and assuming further that a line crew has been despatched to pole 90 to ascend the same and actuate power fuse disconnects 100 and 102 to de-energize fallen line 96; it will be readily understood by those skilled in this art that the said line crew will subsequently complete the reverse side (FIG. 3) of a mark-up tag 82, emplace and thusly completed mark-up tag in the envelope 78 of tag holder 70, and securely mount the safety tagging device 10 of my invention on the pole through use of the elasticized mounting bands 32 and 34, and the included male and female snap attachment members.

Figure 5:
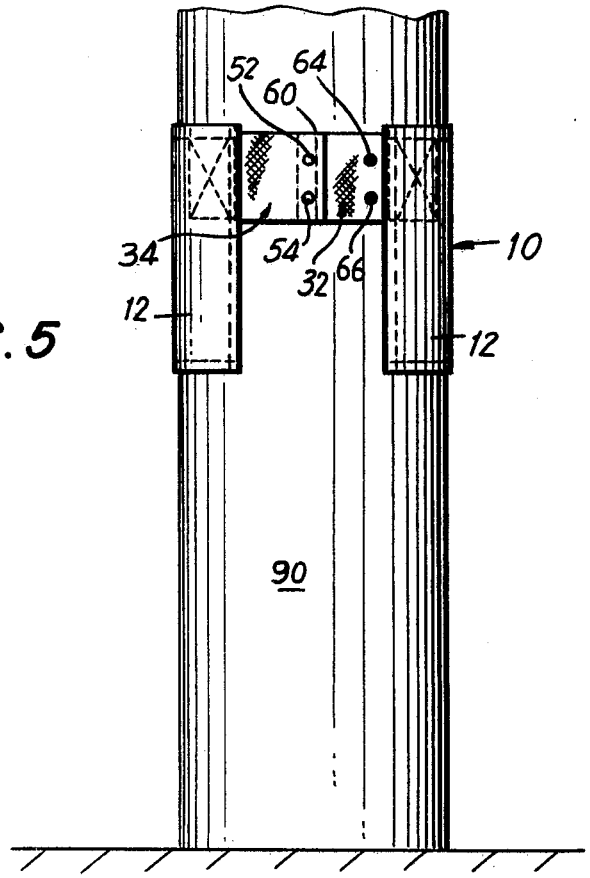
FIG. 5 depicts the relevant rear portion, only, of the pole of FIG. 4.

More specifically, and as illustrated in FIGS. 4 and 5, it may be seen that the secure mounting of the safety tagging device 10 on the pole 90 is readily and conveniently effected by the wrapping of the former around the latter, the stretching of the mounting bands 32 and 34 to insure a tight and secure fit, and the closure of the appropriate sets of the male and female snap attachment members by the pressing of the former into the latter in obvious manner. Thus, and as illustrated for the safety tagging device mounting of FIG. 5, it will be seen that device mounting has been accomplished by the pressing of the intermediate set of male snap attachment members 60 and 62 on mounting band 32 into the set of female snap attachment members 52 and 54 on mounting band 34, while neatly tucking the additional length of the mounting band 32 under the mounting band 34 and relevant part of main body portion 12 to insure a particularly snug and secure fit. Alternatively, and for a thicker pole or other power transmission circuit or related support structure, mounting of the safety tagging device 10 would involve the use of the outer set of male snap attachment members 56 and 58; while mounting of the safety tagging device 10 on a thinner pole or structure would, of course, involve the use of the inner set of male snap attachment members 64 and 66. Thus may in any event be understood that the combined effect of the elasticity of the mounting bands 32 and 34, and the provision of multiple, spaced sets of the female snap attachment members, will be to render the safety tagging device 10 of my invention readily adaptable for particularly secure attachment to a relatively wide variety of different sized support or related structures.

With the safety tagging device 10 of my invention securely attached as described, and as illustrated in FIGS. 4 and 5, to the pole 90, and the disconnect line crew gone, it will be obvious to those skilled in this art that particularly highly visible indicia (which may be even further enhanced by the "streaming" of the streamers 24 and 26 in the wind as shown in (FIG. 4) will be provided by the safety tagging device to any and all line crews subsequently arriving at pole 90, and even under the most adverse conditions of weather and darkness. Thus, and upon arrival of a subsequent line crew at pole 90, and the almost inevitable sighting of the securely emplaced safety tagging device 10, it will be readily understood by those skilled in this art that the mark-up tag 82 will be simply removed from the mark-up tag holder 70, the instructions on the reverse side thereof (which should remain perfectly legible due to the protection of the tag from the weather by envelope 78) read, and the necessary clearances, if any, obtained in accordance with those instructions, all before power transmission and distribution line 96 is re-energized by the line crew in question, and all to particularly significant safety advantage as should be obvious.

For a typical application of the safety tagging device 10 of my invention, it may be understood, that the main body portion 12 may, for example, measure approximately 14 inches by approximately 22 inches to thus, when compared to the prior art practice of displaying a 3 by 4 inch mark-up tag, per se, provide an approximately over twenty-five fold increase in visible area and, in conjunction with the extremely high-visibility color of the main body portion, insure the particularly conspicuous display of the mark-up tag 82.

In addition to use as illustrated and described in the tagging of de-energized power transmission and distribution circuits on poles, it will be understood by those skilled in this art that the safety tagging device 10 of my invention will be equally useful in the tagging of tie points on such circuits, disconnects on transformers and transformer banks, disconnects on regulators, disconnects on capacitors, disconnects on ratio transformers, disconnects on underground pad mounts, switchgears and/or networks or vaults, disconnects in switching transmission circuits at substations, and in the tagging of disconnects in gang operated switches in substation and/or field distribution circuits.

Various changes may, of course, be made in the disclosed embodiment of the safety tagging device of my invention without departing from the spirit and scope thereof as defined in the appended claims.

What is claimed is:

1. In a safety tagging device for the particularly secure and conspicuous mounting and display of a mark-up tag from a riser pole or like structural support member attendant the de-energization of power transmission and distribution circuits and the like which are supported from said riser pole, the improvements comprising, a main body portion of generally quadrangular configuration, said main body portion being sized to present a surface area at least five times greater than that of said mark-up tag, and to be wrappable generally around said riser pole, said main body portion being of a highly durable and visible material, a mark-up tag holder comprising a generally envelope-like member of a substantially waterproof and transparent material which is attached to said main body portion for the protected, yet readily visible, mounting and display of a mark-up tag on said main body portion, and attachment means for securely, yet readily removeably, attaching said main body portion to said riser pole, said attachment means comprising bands of a generally elasticized material attached to opposite sides of said main body portion and extending therefrom, and closure means affixed to said attachment bands and operable to securely, yet readily removeably, secure the same together to attach said main body portion to said riser pole by wrapping said safety tagging device therearound whereby, said mark-up tag will be securely and conspicuously displayed and called to the attention of anyone attempting to re-energize said circuit to prevent the premature re-energization thereof.

2. In a safety tagging device as in claim 1 further comprising, streamer means attached to said main body portion to call attention thereto.

3. In a safety tagging device as in claim 1 wherein, said main body portion is of a blaze fluorescent orange material.

4. In a safety tagging device as in claim 1 wherein, the surface area of said main body portion is at least twenty times greater than the surface area of said mark-up tag.

5. In a safety tagging device as in claim 1 wherein, said attachment bands are of unequal length, and there is a plurality of said closure means at spaced locations on the longer of said bands whereby, said safety tagging device may be readily attached to structures of different thicknesses through use of different ones of said closure means on the longer of said attachment bands.

6. In a safety tagging device as in claim 1 wherein, said main body portion is of a blaze fluorescent orange material, and said attachment bands are of a white material for contrast therewith.

7. In a safety tagging device as in claim 1 wherein, said main body portion is of a blaze fluorescent orange material, and said attachment bands are of a black material for contrast therewith.

8. In a safety tagging device as in claim 1 wherein, said main body portion, said attachment bands, and said mark-up tag holder are fabricated from particularly durable and weather-resistant synthetic materials.

9. In a safety tagging device as in claim 9 further comprising, strengthening seams formed at the respective edge portions of said main body portion and said attachment bands, and wherein said mark-up tag holder is riveted to said main body portion.

* * * * *